US005957294A

United States Patent [19]

Kanter

[11] Patent Number: 5,957,294

[45] Date of Patent: Sep. 28, 1999

[54] DISPLAY CONTAINER HAVING REINFORCING INSERT

[76] Inventor: Allen Kanter, 1042 Gypsy Hill Rd., Gwynedd Valley, Pa. 19437

[21] Appl. No.: 08/993,902

[22] Filed: Dec. 18, 1997

Related U.S. Application Data

[60] Provisional application No. 60/034,293, Dec. 18, 1996.

[51] Int. Cl.[6] ..... B65D 21/02

[52] U.S. Cl. ..... 206/774; 229/199; 229/241; 229/919

[58] Field of Search ..... 206/736, 738, 206/745, 746, 774, 503; 229/199, 241, 242, 915, 919

[56] References Cited

U.S. PATENT DOCUMENTS

| | | | |
|---|---|---|---|
| 1,150,852 | 8/1915 | Davidson . | |
| 2,556,915 | 5/1951 | Guyer . | |
| 2,698,124 | 12/1954 | Hines . | |
| 2,762,550 | 9/1956 | Goettsch et al. . | |
| 2,922,565 | 1/1960 | Roderick et al. . | |
| 2,944,726 | 7/1960 | McCauley . | |
| 2,973,127 | 2/1961 | Royce . | |
| 3,024,958 | 3/1962 | Loderhose . | |
| 3,110,434 | 11/1963 | Linda et al. . | |
| 3,175,748 | 3/1965 | Flamm et al. . | |
| 3,315,875 | 4/1967 | Praetorius . | |
| 3,325,003 | 6/1967 | Bilezerian . | |
| 3,934,790 | 1/1976 | Easter | 229/919 |
| 4,000,811 | 1/1977 | Hardison et al. | 229/242 |
| 4,201,291 | 5/1980 | Davidson | 229/242 |
| 4,946,042 | 8/1990 | Ferreri et al. . | |
| 5,167,324 | 12/1992 | Miller | 206/738 |
| 5,209,597 | 5/1993 | Flaming | 229/915 |
| 5,335,844 | 8/1994 | Young | 229/919 |
| 5,361,974 | 11/1994 | Earl et al. | 229/919 |
| 5,505,371 | 4/1996 | O'Neill | 229/242 |

*Primary Examiner*—Paul T. Sewell
*Assistant Examiner*—Luan K. Bui
*Attorney, Agent, or Firm*—Synnestvedt & Lechner

[57] ABSTRACT

A container assembly having a removable display panel formed in a wall panel defined by a separation line along which the display panel is separable from the remainder of the wall panel. An insert panel is secured to the inner face of the wall panel and positioned to overlap at least a portion of the separation line and reinforce the wall panel.

20 Claims, 8 Drawing Sheets

Fig. 3
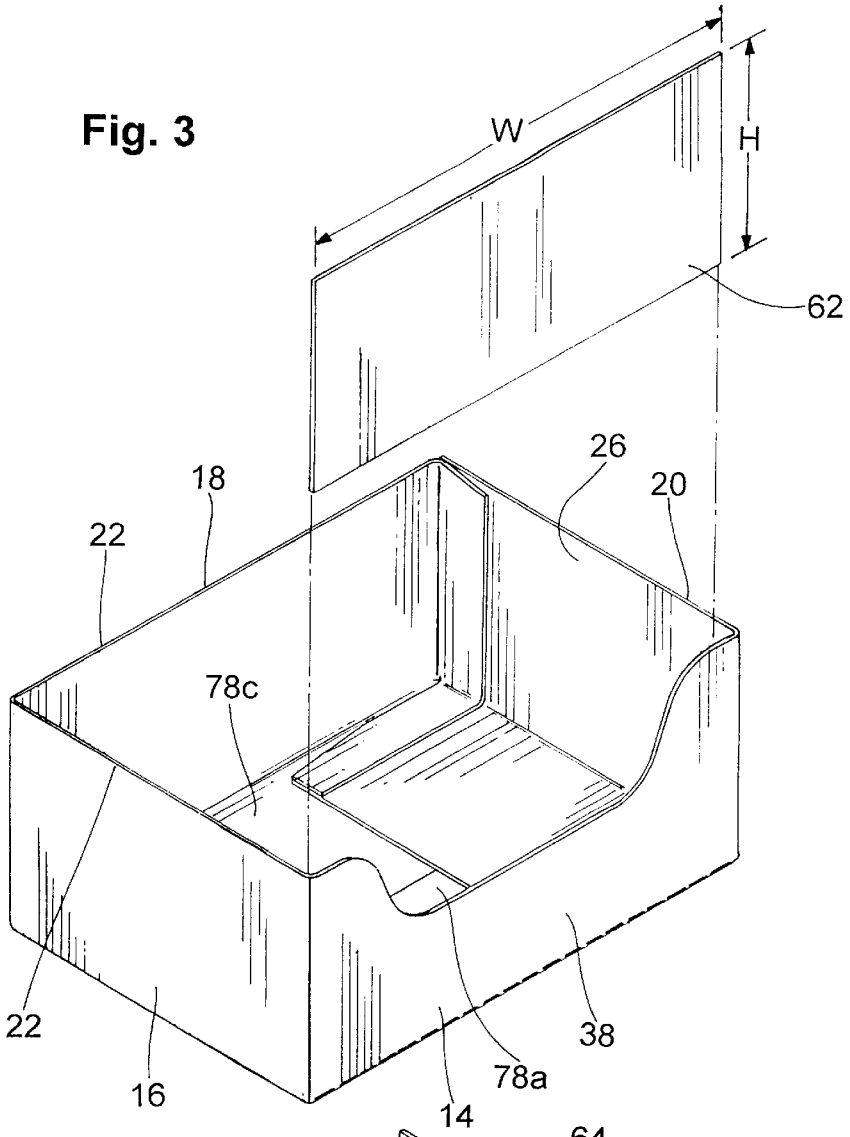
Fig. 3A
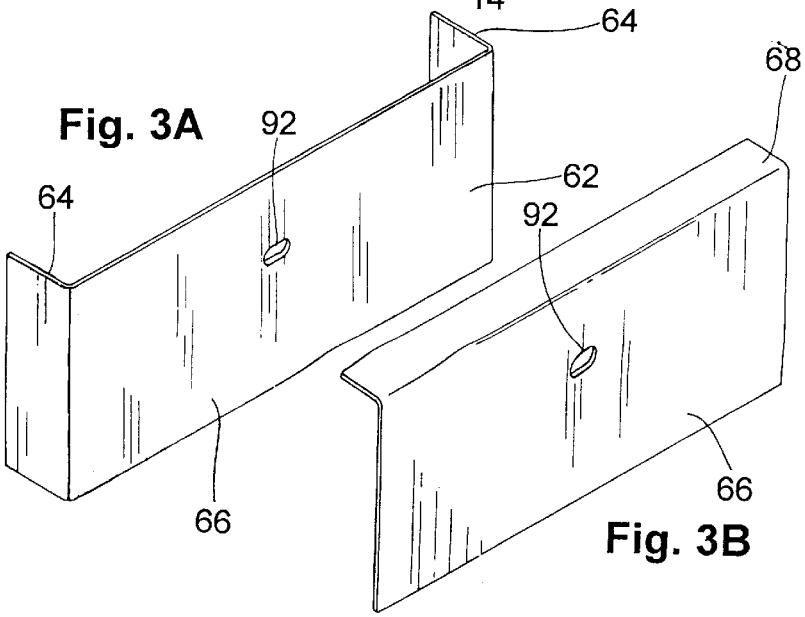
Fig. 3B

DISPLAY CONTAINER HAVING REINFORCING INSERT

CROSS REFERENCE TO RELATED APPLICATION

This application claims the benefit of U.S. Provisional Application No. 60/034,293, filed Dec. 18, 1996.

BACKGROUND OF THE INVENTION

1. Field of the Invention

The present invention relates to containers made from paperboard, and more particularly to stackable containers used for both shipping and display and which have a removable display section.

2. Description of the Related Art

Corrugated containers are widely used to both ship and display goods such as food and candy items. The practice of displaying goods in shipping containers has become more popular with the advent of large warehouse style stores and supermarkets where the containers are stacked one on top of another on the retail floor.

A popular type of display container has one or more removable sections or panels typically defined by perforated tear lines. Such containers are generally formed from a one piece blank suitably cut, scored, and perforated to enable subsequent folding of the blank into the final closed container. After receiving the packaged goods, the retailer removes the display section from the container to provide access to the goods within even when the container is stacked.

A major consideration in design of such containers is its compression or stacking strength. All too often containers collapse or become misshaped under the weight of the containers stacked on top. The inclusion of perforation lines to permit easy separation of the display panel reduces the structural integrity and compression strength of the container. The stress of stacking a large number of containers on top of each other may cause inadvertent opening or bending of the container along the perforation lines, and result in failure or collapse of the container. This destroys the aesthetic appearance of the container and damages the products within.

Tall stacks of containers are necessary to maximize utilization of cargo, warehouse, and retail floor space. Thus the problem has been to balance the maximization of compressive strength of the container, and the economizing of the material and manufacturing costs to manufacture the container.

A further consideration is the compatibility of the containers with automated manufacturing and packaging equipment. Containers are typically made on automated production lines. Any suitable container design or modification to improve the strength of a container should be compatible with such production equipment. Furthermore, the packagers typically use automated packaging lines which assembles the container from a flat knockdown state and loads the container with goods prior to the container being closed. Any method of reinforcing a container should not interfere with automated packaging equipment.

Accordingly, one object of the present invention is to provide a shipping/display container having improved compression and stacking strength.

Another object of the present invention is to provide a container having a reinforcing insert that is compatible with automated packaging equipment.

A further object of the present invention is to provide a container with a reinforcing insert that is easily added to the container during the manufacturing process.

A still further object of the present invention is to provide a display container having improved stacking strength that is economical to make and requires minimal additional material.

Another object of the present invention is to provide a display container that will not buckle or open along the perforation tear line.

Additional objects, advantages and novel features will be set forth in part in the description which follows, and in part will become apparent to those skilled in the art upon examination of the following or may be learned by practice of the invention. The objects and advantages of the invention may be realized and attained by means and the elements in combinations particularly pointed out in the appended claims.

SUMMARY OF THE INVENTION

The present invention provides an improved shipping/display container. Broadly, the invention provides a container assembly having multiple side panels attached to one another for forming the sides of the container. The multiple side panels include a first side panel that has an inner face facing the interior of the container and a top edge. A removable display panel is formed in the first side panel. The removable display panel has an upper edge which is defined by at least a portion of the top edge of the first side panel and is further defined by a first separation line along which the display panel is separable from the remainder of the first wall panel. A container top includes a first top panel that is integrally attached to the upper edge of the first side panel. A removable top section is provided which includes at least a portion of the first top panel. This removable top section is integrally attached to the upper edge of the removable display panel. At least one bottom forming flap is provided for forming the bottom of the container. Secured to the first side panel on its inner face is an insert panel. The insert panel is positioned in an overlapping relationship with at least a portion of the first separation line.

The separation line forms a line of relative weakness in the container which allows easy tearing or separation of the various sections. As discussed more fully below, the separation line preferably comprises a series of perforations or cuts in the container. The insert is provided to reinforce the container where weakened due to the separation line.

BRIEF DESCRIPTION OF THE DRAWINGS

The foregoing summary and the following detailed description may be better understood when read in conjunction with the accompanying drawings. For the purpose of illustrating the invention, two preferred embodiments are shown in the drawings. It is understood, however, that this invention is not limited to the precise arrangements or configurations shown.

FIG. 3 is a perspective view of the container of FIG. 2 showing the insert panel removed;

FIG. 3A is an alternative configuration for the insert panel;

FIG. 3B is a second alternative configuration for the insert panel;

DETAILED DESCRIPTION OF THE INVENTION

Figure 1:
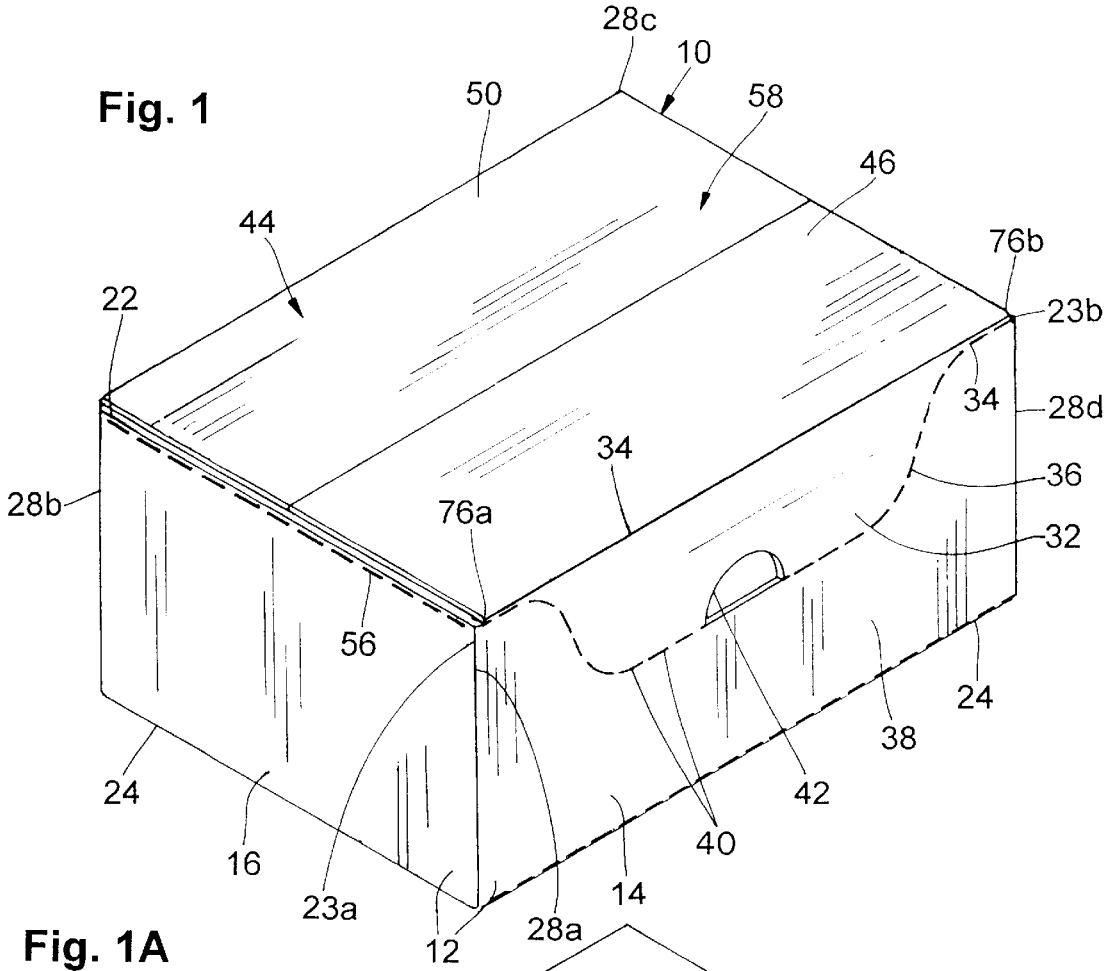
FIG. 1 is a perspective view of a container assembly in accordance with the present invention shown in an assembled closed state.

Described below are two embodiments particularly suited for use as shipping and display containers. It is readily understood, however, that the present invention can be adapted to containers used for other purposes.

Reference is now made to a preferred embodiment of the invention illustrated in FIGS. 1, 1A, 2, and 3 showing a shipping/display container assembly 10 in its fully assembled/closed state. The container 10 has multiple side panels 12 integrally attached to one another as shown, and which includes a first side panel 14, a second side panel 16, a third side panel 18, and a fourth side panel 20. Each of the multiple side panels 12 has a top edge 22, a bottom edge 24, and an inner face 26 facing the interior of the container 10. The container side panels are attached to one another at corners 28*a*, 28*b*, 28*c* and 28*d*, the third and fourth side panels 18 and 20 being secured together with a glue tab 30 using an adhesive such as glue as known in the art.

A removable display panel 32 is formed in the first side panel 14. It has an upper edge 34 defined by at least a portion of the top edge 22 of the first wall panel 14, and is further defined at its bottom and side ends by a separation line 36 extending from opposite sides 23*a*, 23*b* of the top edge 22 of the first side panel 14, to divide the first side panel 14 into two sections—the display panel 32, and the remainder 38.

The separation line 36 is curved to form the display panel 32 having the desired shape and size. The separation line 36 forms a line of relative weakness in the container 10 allowing easy tearing or separation of the various sections. The separation line 36 preferably comprises a series of perforations 40 or cuts through the panel 14, with uncut lengths between each perforation. Perforations of about one-half inch in length, with uncut lengths in between the perforation of about three-sixteenths of an inch are preferable. The perforations can be curved as shown. Any suitably dimensioned perforation may be used, as well as any suitable type of separation line. A hand opening 42 is provided for easy grasping and removal of the display panel 32 as further described below.

A container top 44 includes a first top flap 46, a second top panel 48, a third top flap 50 and a fourth top flap 52, each being integrally attached to the upper edge 22 of respective side panels 14, 16, 18 and 20.

Figure 2:
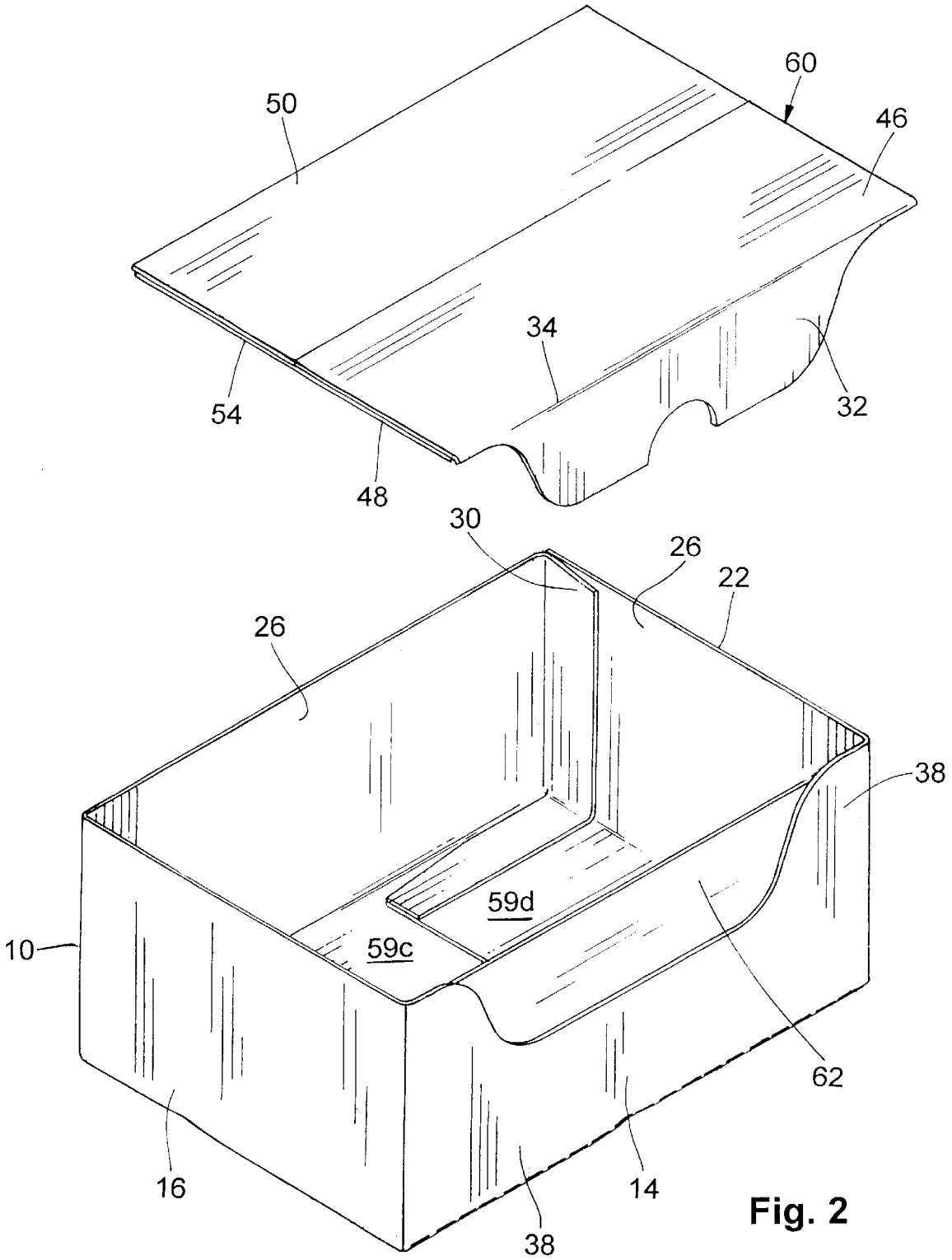
FIG. 2 is a perspective view of the container of FIG. 1 having a removable section which has been removed and showing the insert panel in the interior of the container.

A removable top section 54 allows access through the top of the container 10 as seen in FIG. 2. The removable top 54 includes at least a portion of the first top flap 46 and is integrally attached to the upper edge 34 of the display panel 32. In the present embodiment, the removable top section 54 includes the entire first top flap 46 and further includes the second, third and fourth top flaps, 48, 50 and 52. (See FIG. 2). A second separation line 56 is positioned between each of the second, third, and fourth top flaps 48, 50, 52 and the side panels 16, 18 and 20 to which they are attached. The top flaps 48, 50, 52 are separable from the container 10 along the separation line 56. It is seen that the second separation line 56 extends around the top edges 22 of the second, third and fourth side panels 16, 18, 20 and has end portions 76*a*, 76*b* joining the first separation line 36. The separation line 36 preferably comprises a series of perforations as previously described above.

When the container assembly 10 is in its fully assembled and closed state as shown in FIG. 1, the first, second, third, and fourth flaps 46, 48, 50, 52 have been folded and glued to one another as known in the art to form a closed container top 58 as seen in FIG. 1. As seen in FIG. 2, the display panel 32 and the closed container top 58, integrally connected along the upper edge 34 of the display panel 32, is separable from the container 10 as a single unit 60 along the first and second separation lines 36, 56. To accomplish this, the display panel 32 is grasped at the opening 42 and pulled upward away from the container 10, tearing the container along the first separation line 36. The container top 58 is then pulled back to tear the container along the second separation line 56.

Bottom forming flaps 59*a*, 59*b*, 59*c* and 59*d*, integrally attached to the multiple side panels 12, form the bottom of the container 10. Numerous styles of bottoms and bottom forming flaps may be used. This includes crash-lock, RSC and other types of bottoms.

An insert panel 62 is secured to the inner face 26 of the first side panel 14 in an overlapping relationship with at least a portion of the separation line 36. Preferably, the insert 62 is substantially the same height and width of the first side panel 14 although the insert should be no wider than permitted by the opening on the top of the container 10 through which it is removed (see FIG. 3), which in this case is the full width of the first top flap 46 (same as first side panel 14). The insert 62 provides an additional support wall adjacent the first side panel 14, which is weakened due to the perforations, and thereby increases the weight that the first side panel 14 can support. Moreover, the insert 62 helps protect the first side panel 14 from bending and opening along the separation line 36.

The insert panel 62 is preferably secured to the first side panel 14 with an adhesive such as glue as known in the art. Sufficient glue should be used to maintain the insert panel 62 adjacent the first side panel 14 while still allowing the insert 62 to be broken away and removed. One glue pattern found to be suitable comprises two dots of glue placed between the insert 62 and that part of the first side panel 14 forming the display panel 32, and five dots of glue between the insert 62 and the remainder 38. As seen in FIG. 3, the insert 62 is removed after the display panel 32 and the container top 56 are removed. The glued joints between the remainder 38 of the first side panel 14 and the insert 62 are broken simply by pushing in the insert 6 towards the inside of the container.

FIG. 3A illustrates an alternative configuration of the insert panel 62 having side extensions 64 extending perpendicularly from the side ends of the main insert section 66. The extensions 64 are adjacent respective side panels 16, 18 and, being of the substantially same height of the side wall panels, add additional reinforcement. The side extensions 64 are integrally attached to the main insert section 66 and foldable as necessary to conform to the configuration of the container assembly 10 as it moves between its knockdown state and its fully assembled closed state as further described below.

FIG. 3B illustrates another alternative configuration of the insert panel 62 having an integrally attached upper lip 68. The upper lip 68 extends perpendicularly from the main section 66 of the insert 62 and adds additional support.

The container 10 is preferably made from corrugated paperboard as widely used in the art.

The container assembly 10 has a knockdown state 70 which is opened and folded to form the assembled container 10. The term "knockdown" refers to the flat unassembled assembly 70 as shown in FIG. 4 and which is easily opened to form the assembled and closed container shown in FIG. 1.

The container 10 can be easily manufactured in the knockdown state 70. Because they are flat, knockdowns are conveniently bundled and shipped to the packager for quick assembly into the assembled container 10 using automated equipment.

Figure 1A:
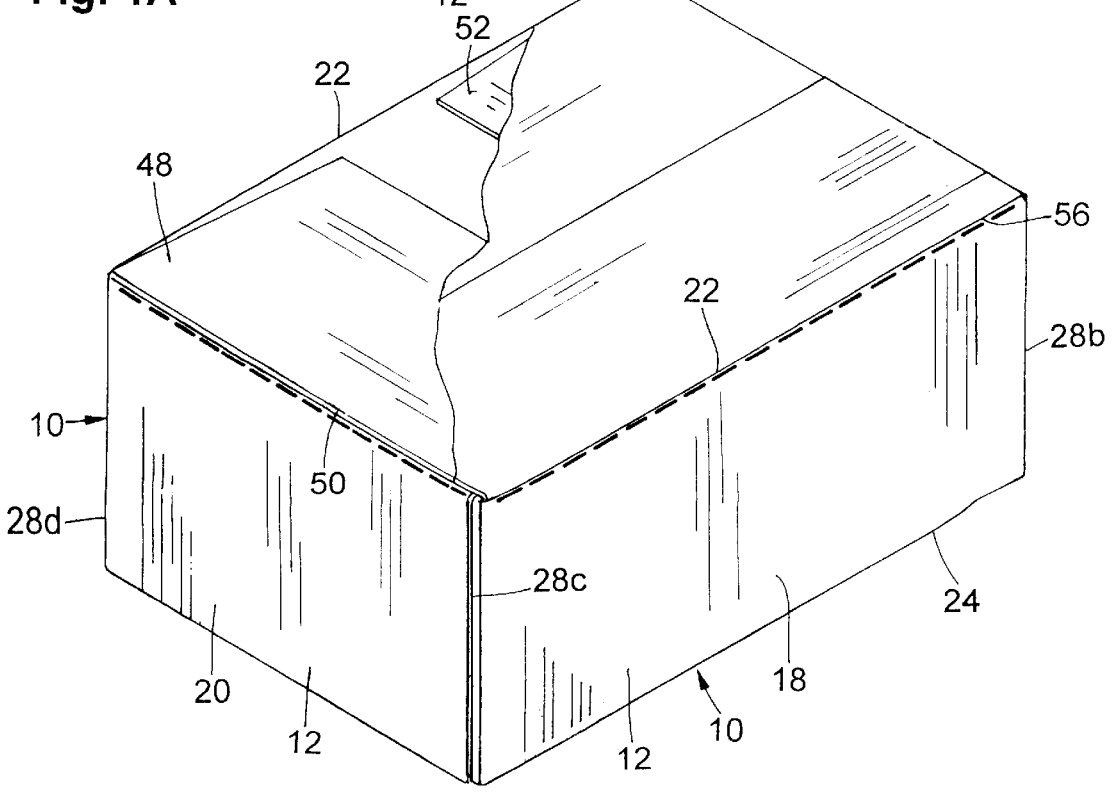
FIG. 1A is a perspective view of the back side of the container shown in FIG. 1.
Figure 4:
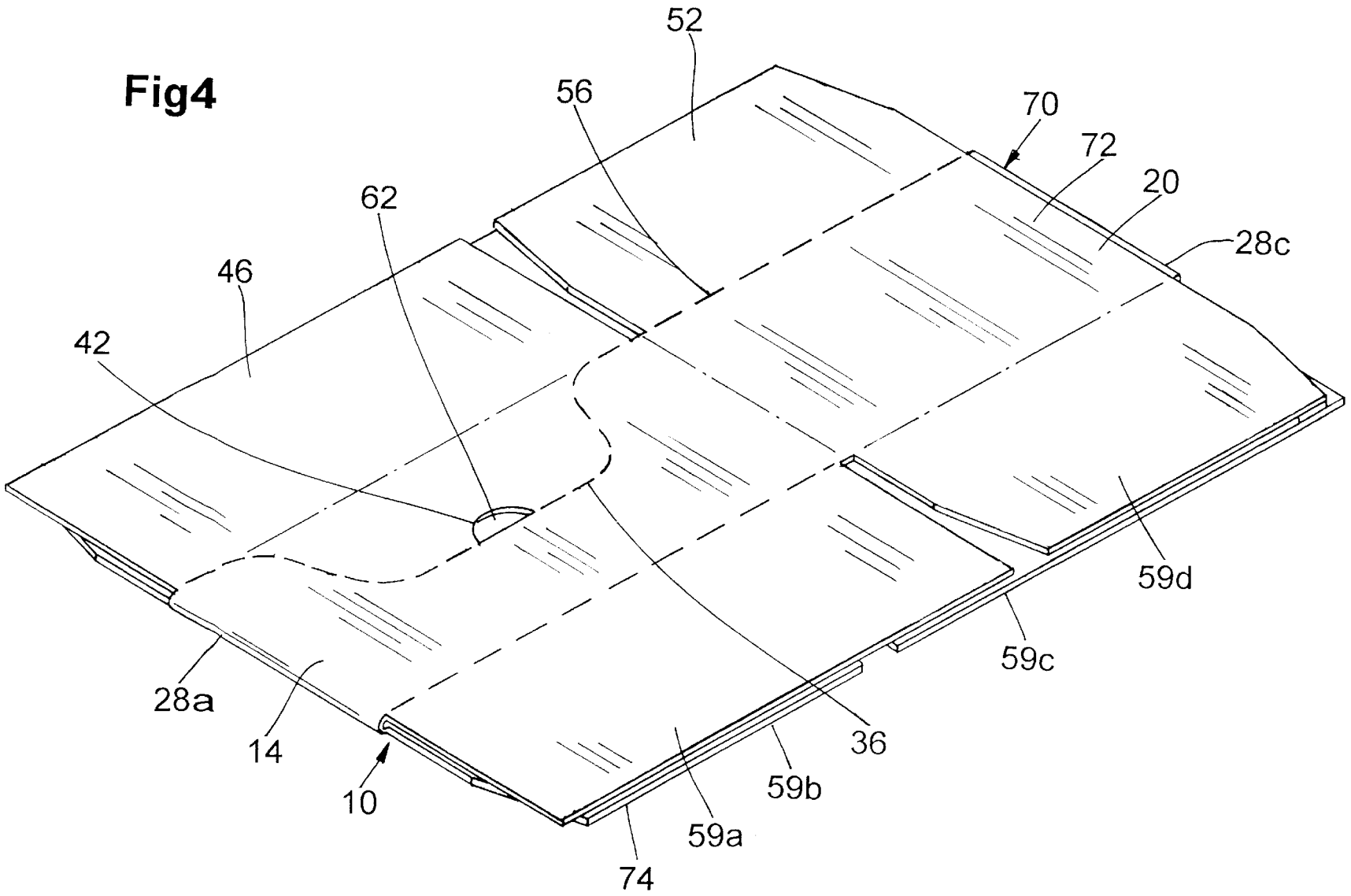
FIG. 4 is a perspective view of the container of FIG. 1 shown in the knockdown state.

Referring to FIGS. 4, 1 and 1A, the knockdown 70 has a first flat side 72 and a second flat side 74 attached to each other at opposite ends at corners 28*a*, 28*c* as shown. These corners correspond to the same corners 28*a*, 28*c* of container 10 shown in FIGS. 1 and 1A. The flat walls 72 and 74 include the side panels 12 that will form the final container 10. In the illustrated embodiment, the first flat wall 72 includes the first and fourth side panels 14, 20 and the first and fourth top flaps 46, 52 in a substantially same plane. It is understood that "substantially same plane" does not mean exactly the same plane. Likewise, the second flat wall 74 includes second and third side panels 16, 18 and second and third top flaps 48, 50 all in a substantially same plane which is substantially parallel to the plane for the first flat wall 72. The bottom forming flaps 59*a*–59*d* are likewise divided among the two knockdown walls as shown. The insert 62, secured to the inner face 26 of the first side panel 14, is sandwiched between and substantially parallel to the knockdown walls 72 and 74 as shown in FIG. 4 (visible through the opening 42).

To assemble the knockdown 70 to the fully assembled shipping/display container 10, the two knockdown flat walls 72 and 74 are pushed apart, folding the flat walls 72 and 74 to form the corners 28*b*, 28*d* and create the basic shape of the container 10 as seen in FIG. 1. The container bottom is then assembled folding the bottom forming flaps 59*a*–59*d* as known in the art. An example of a knockdown is disclosed in U.S. Pat. No. 5,505,368 which is hereby incorporated by reference.

Figure 5:
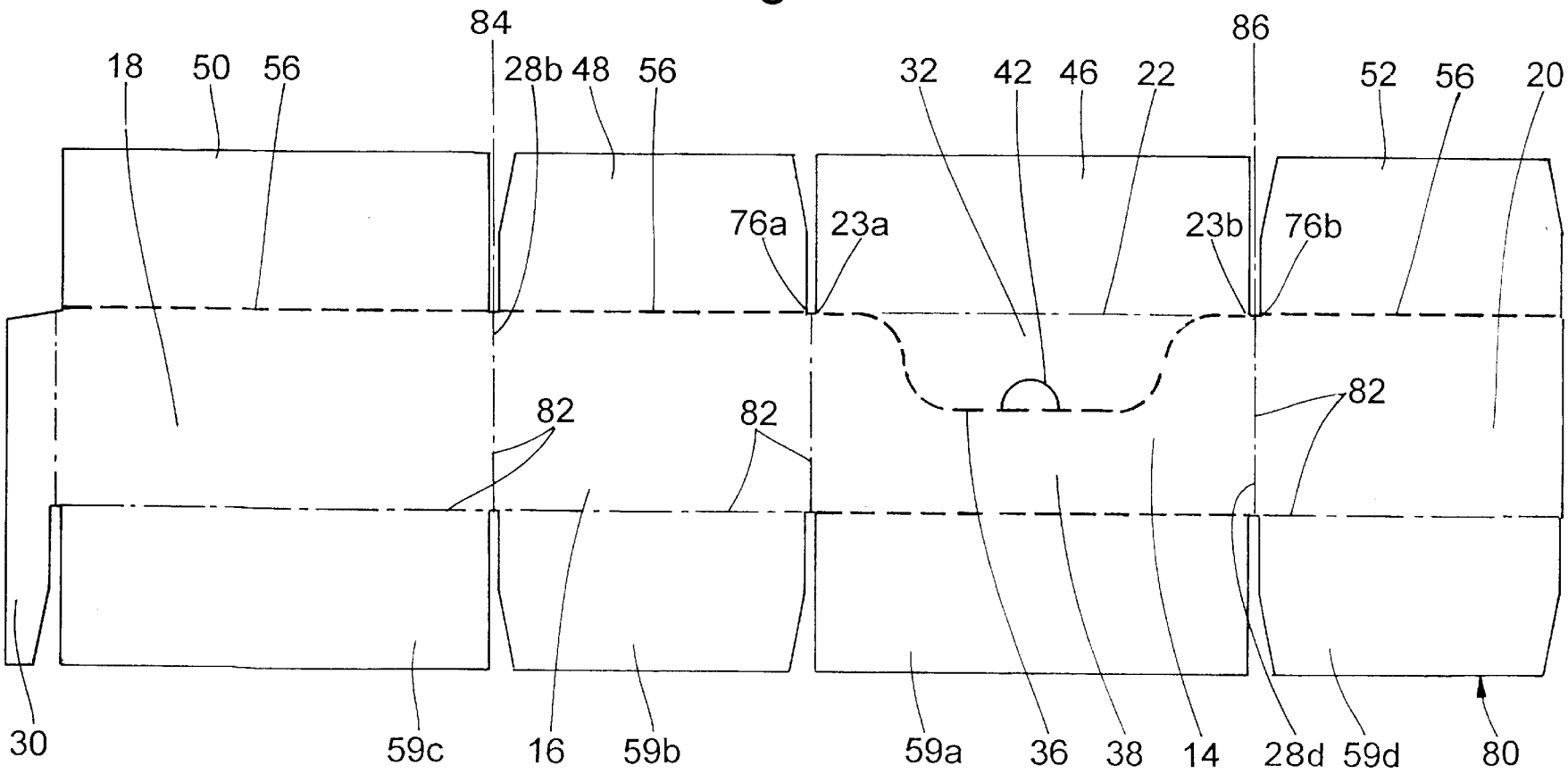
FIG. 5 illustrates a blank which can be assembled into the knockdown state shown in FIG. 4.

Illustrated in FIG. 5 is a blank 80 for forming the container assembly 10 having the knock-down state 70 as shown in FIG. 4 and the fully assembled state as shown in FIG. 1. The blank 80 is a die-cut unitary piece of corrugated paperboard having integrally attached first, second, third and fourth side panels 14, 16, 18 and 20 and first, second, third and fourth top flaps 46, 48, 50 and 52 integrally attached to respective side panels as shown. The side panels 14, 16, 18 and 20 are separated by fold lines 82. Bottom flaps 59*a*, 59*b*, 59*c* and 59*d* are integrally attached to respective side wall panels as shown and separated therefrom by fold lines 82.

The first separation line 36 comprising perforations as shown is formed into the first side panel 14. The second separation line 56 is formed along the second, third and fourth side panels 16, 18 and 20 as shown. The hand opening 42 is cut into the blank 80.

The insert panel 62 (as seen in FIG. 3) is formed separately from a piece of corrugated paperboard and secured to the inner face 26 of the first side panel 14. It is seen that in the present embodiment, the insert panel 62 is substantially the same width (W) and height (H) as the first side panel 14 to which it is secured, although slightly less in dimension to fit in the inside of the assembled container 10.

The fold lines 82 may take any suitable form as known in the art, score and crease lines being preferable. The blank 80 can be assembled into the knockdown 70 during manufacture. With the blank 70 in a flat position as shown in FIG. 5, and with the insert panel 62 already glued to the inner face 26 of the first side panel 14, the side panel 18 having the glue tab 30, top panel 50 and bottom panel 59*c* are folded as a flat unit about the line 84 onto the remainder of the blank 80 to create the corner 28*b*. The side panel 20 with the top flap 52 and bottom flap 59*d* is then folded as a flat unit about the line 86 onto the glue tab 30 thereby forming the corner 28*d*. The side panel 20 is glued to glue tab 30. It is seen that this readily forms the knockdown 70 shown in FIG. 4 with the insert panel 62 sandwiched between the knockdown walls 72 and 74.

Figure 6:
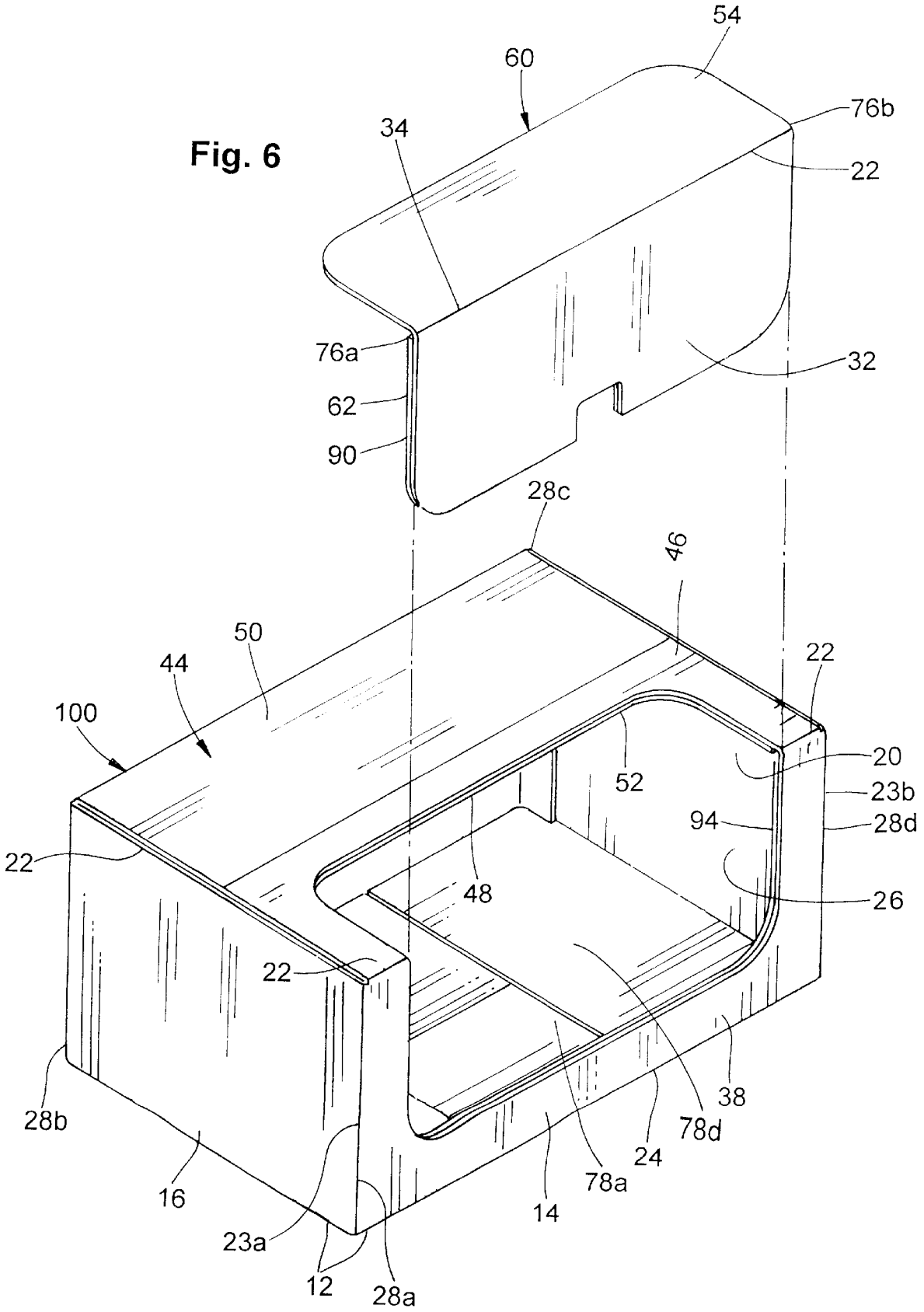
FIG. 6 is a perspective view of a second container embodiment made in accordance with the invention having a removable section shown removed.

A second embodiment is now described with reference to FIGS. 6, 6*a* and 7. The container 100 shown in FIG. 6 is similar to the container 10 shown in FIG. 1 with similar elements labeled with the same reference numbers. Here, the removable display panel 32 formed in the first side panel 14 has an upper edge 34 defined by a portion of the top edge 22 of the first side panel 14. The upper edge 34 does not extend to the side ends 23*a*, 23*b* of the first side panel 14 as does the embodiment illustrated in FIG. 1.

The removable top section 54 is limited to a portion of the first top panel 46 and is integrally attached to the upper edge 34 of the display panel 32. The second separation line 56 is spaced on the first top panel 46 from the upper edge 34 and has end portions 76*a*, 76*b* joining the first separation line 36 to form a single unit 60 removable from the container 100.

Figure 6A:
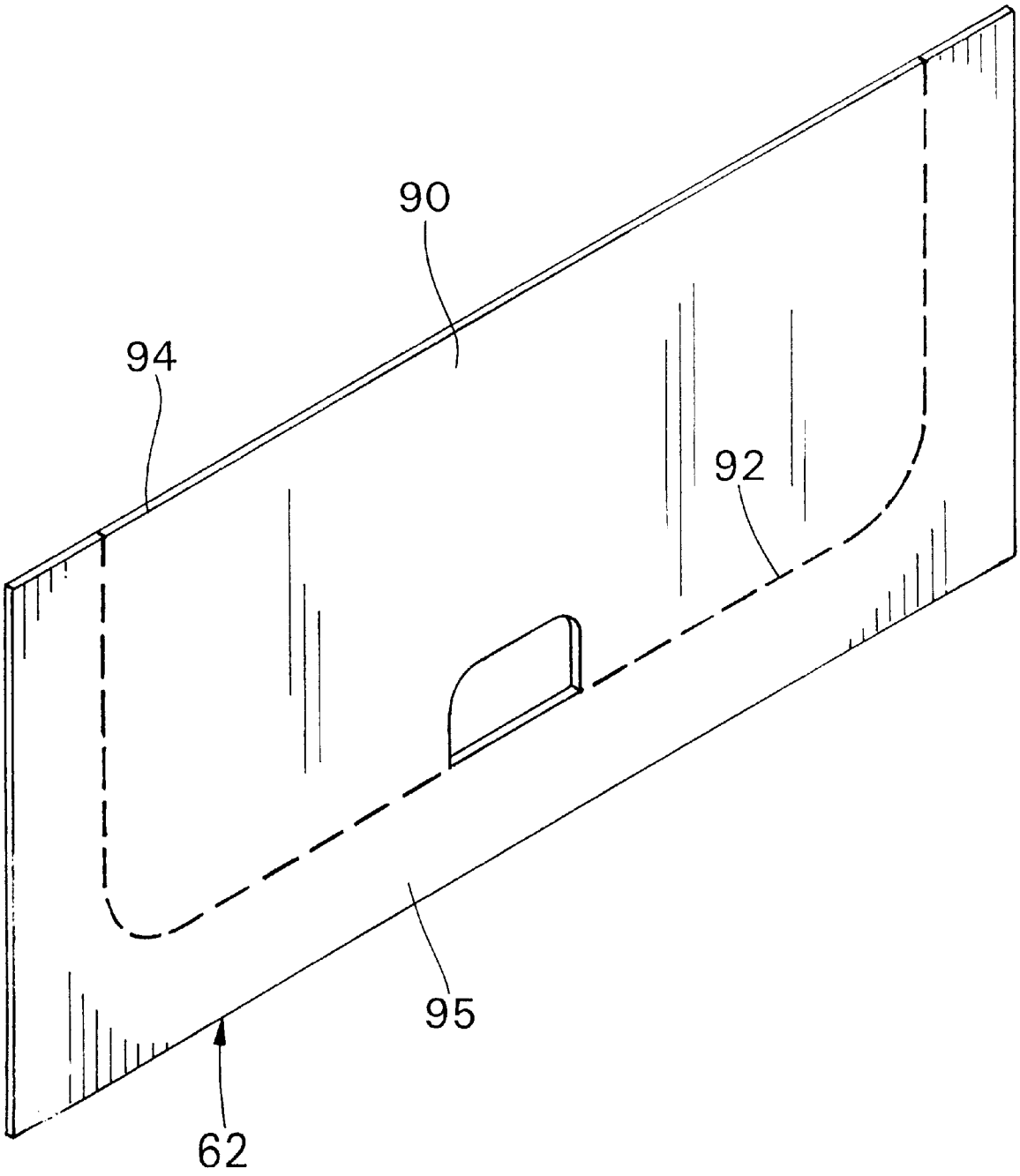
FIG. 6A is a perspective view of an insert panel for use with the container of FIG. 6.

FIG. 6*a* illustrates an insert panel 62 for use with the container shown in FIG. 6. The insert panel 62, has the substantial same height and width as the first side panel 14, to maximize the reinforcement.

As the opening formed in the container 100 upon the removal of the display panel 32 and the removable top panel 54 has a narrower width than that of the insert panel 62, the insert panel 62 includes a removable partial section 90 defined by a third separation line 92 joining the upper edge 94 of the insert panel 62. The partial section 90 is preferably the same size and configuration as the display panel 32 for aesthetic purposes, and no wider than the opening formed upon removal of the removable top panel 54 so that the partial section 90 can be easily removed from the container.

The insert 62 is secured to the inner face 26 of the first wall panel 14 with an adhesive such as glue. Since the remainder 95 of the insert 62 will remain in the container 100, a stronger glue pattern may be used, such as a line of glue running the full height of the insert 62 on each side of the removable partial section 90. Glue may or may not be applied to the removable insert section 90 to secure it to the back side of the display panel 32.

The container assembly 100 has a knockdown state as described above with reference to FIG. 4.

Figure 7:
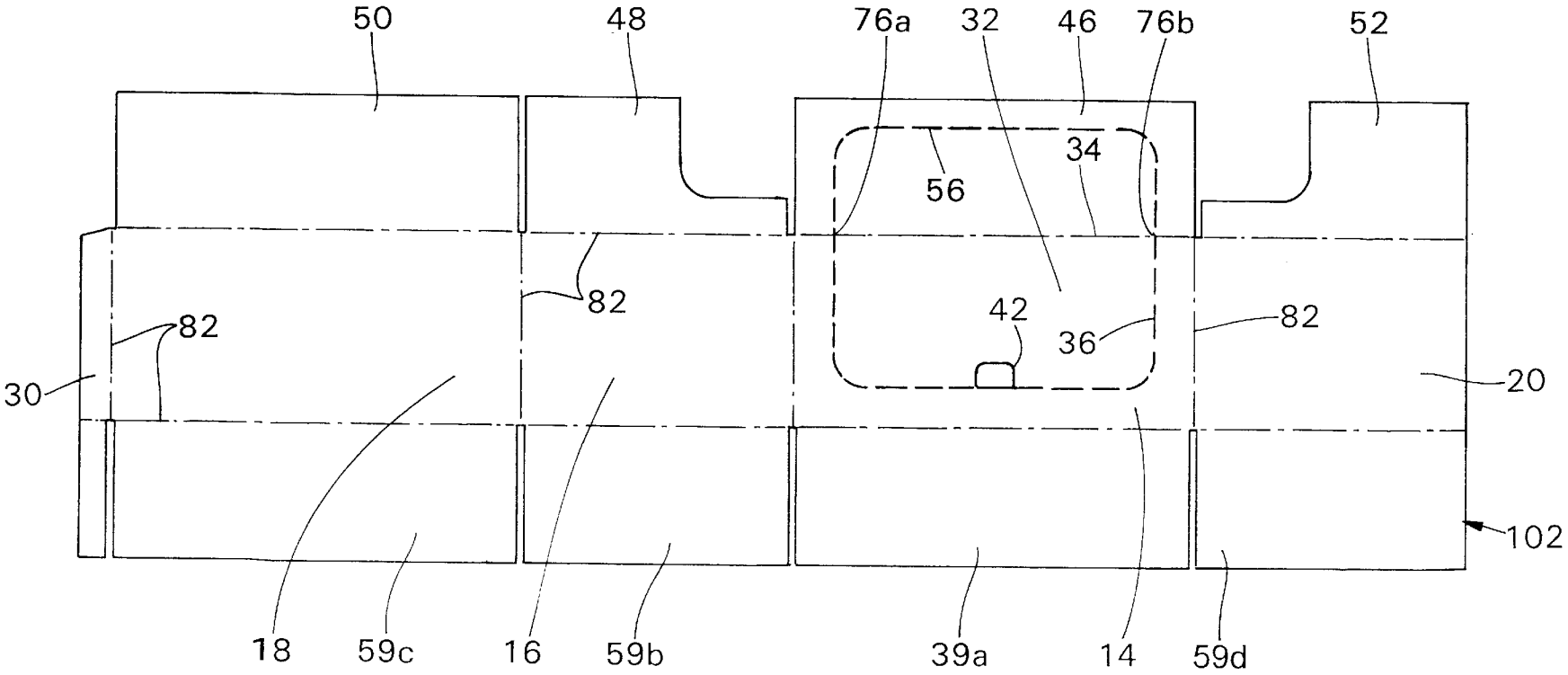
FIG. 7 illustrates a container blank which can be assembled into the container of FIG. 6.

Illustrated in FIG. 7 is a blank 102 for forming the fully assembled container 100 shown in FIG. 6. The blank 102 is preferably die cut from a unitary piece of corrugated paperboard, and has side panels 14, 16, 18 and 20, top flaps 46, 48, 50 and 52, and bottom flaps 59*a*, 59*b*, 59*c* and 59*d* as described above with reference to the embodiment of FIG. 5. Fold lines 82, preferably score lines, are similarly provided.

The first separation line 36 comprising perforations as shown, is provided in the first side panel 14; the second separation line 56 is provided in the first top panel 46.

The insert panel 62 as seen in FIG. 6*a*, is cut separately and secured to the inner face 26 of the first wall panel 14 prior to the folding steps to form the knockdown state of the container 100 as described above with reference to FIG. 4.

As described above with reference to the two preferred embodiments, the present invention provides a new and novel means of increasing the compression strength of display containers having side panels weakened by separation lines such as those formed by perforations. The insert panel 62 requires minimal additional material and is easily added to the container during the manufacturing process with minimal modification of the manufacturing line. As the blank moves down the assembly line, the desired glue pattern is added and the insert 62 accurately placed onto the blank by the machinery. Likewise, at the packaging facilities where the goods are added to the container, the insert 62 is held securely by the glue against the inner face of the first side panel so as not to interfere with the automated loading of the goods into the container which in some equipment comes up from the bottom to place the goods into the container before the bottom flaps are folded to complete the bottom of the container.

While particular embodiments of the invention are described herein, it is not intended to limit the invention to such disclosure. Changes and modifications may be incorporated and embodied within the scope of the appended claims.

What is claimed is:

1. A container assembly comprising:

multiple side panels attached to one another and including a first side panel having an inner face and a top edge;

a removable display panel formed in said first side panel, said display panel having an upper edge defined by at least a portion of the top edge of said first side panel and further defined by a first separation line along which said display panel is separable from the remainder of the first side panel;

a container top including a first top panel integrally attached to said first side panel at said top edge;

a removable top section including at least a portion of said first top panel, said removable top section being integrally attached to said upper edge of said display panel;

at least one bottom forming flap; and an insert panel secured to said first side panel on the inner face thereof, said insert being positioned in overlapping relationship with at least a portion of said first separation line.

2. A container in accordance with claim 1 wherein said removable top section includes a second separation line spaced on said first top panel from said upper edge, said second separation line having end portions joining said first separation line.

3. A container in accordance with claim 2 wherein said first and second separation lines comprise perforations.

4. A container in accordance with claim 3 wherein said insert panel has a height substantially equal to a height of said first wall panel.

5. A container in accordance with claim 4 wherein said insert panel has a width substantially equal to a width of said first wall panel.

6. A container in accordance with claim 1 wherein said insert is adhesively secured to said inner face.

7. A container in accordance with claim 2 wherein said insert incudes a removable insert section defined by a third separation line in said insert spaced from a top edge of the insert, the remainder of said insert being adhesively secured to the inner face.

8. A container in accordance with claim 1 wherein said removable top section further includes a second, third and fourth top panel, each being integrally attached to the upper edge of said multiple side panels, and further including a second separation line dividing said second, third and fourth top panels from said multiple side panels, said second separation line having end portions joining said first separation line.

9. A container in accordance with claim 8 wherein said first and second separation lines comprises perforations.

10. A container in accordance with claim 9 wherein said insert panel has a height substantially equal to a height of the first wall panel.

11. A container in accordance with claim 10 wherein said insert panel has a width substantially equal to a width of the first wall panel.

12. A container in accordance with claim 11 wherein said insert is adhesively secured to said inner face.

13. A container in accordance with claim 1 wherein said insert includes a handle opening.

14. A container in accordance with claim 1 wherein said insert includes a main section secured to said first side panel and a perpendicular extension integrally attached to a side end of said.

15. A container in accordance with claim 1 wherein said insert includes a main section secured to said first side panel and a lip extending from the upper end of said main section.

16. A container in accordance with claim 7 wherein said removable insert section is adhesively secured to the inner face of said removable display panel.

17. A container assembly comprising:

multiple side panels attached to one another and having a top edge and an inner face, said multiple side panels including a first side panel;

a removable display panel formed in said first side panel, said display panel having an upper edge defined by at least a portion of the top edge of said first side panel and further defined by a first separation line along which said display panel is separable from the remainder of the first side panel;

a first top panel integrally attached to the top edge of said first wall panel, and second, third and fourth top panels integrally attached to the upper end of said multiple side panels;

a second separation line positioned between each of said second, third and fourth side panels and said multiple side panels, said second separation line having end portions joining said first separation line thereby forming a single unit removable from the container;

at least one bottom forming flap; and an insert panel secured to said first side panel on the inner face thereof, said insert being positioned in overlapping relationship with at least a portion of said first separation line.

18. A container in accordance with claim 17 wherein said first and second separation lines comprise perforations.

19. A container in accordance with claim 18 wherein said insert has a height substantially equal to a height of said first side panel.

20. A container comprising:

multiple side panels attached to one another and having a top edge and an inner face, said multiple side panels including a first side panel;

a removable display panel formed in said first side panel, said display panel having an upper edge defined by at least a portion of the top edge of said first side panel and further defined by a first separation line along which said display panel is separable from the remainder of the first side panel;

a first top panel integrally attached to said first wall panel at said top edge, said top panel includes a second separation line spaced from said upper edge, said second separation line having end portions joining said first separation line;

at least one bottom forming flap; and an insert panel secured to said first side panel on the inner face thereof, said insert being positioned in overlapping relationship with at least a portion of said first separation line.

* * * * *